United States Patent [19]

Ammon

[11] 3,975,078

[45] Aug. 17, 1976

[54] FOLDED ELECTRICAL CONTACT

[75] Inventor: John Preston Ammon, Dallas, Tex.

[73] Assignee: Elfab Corporation, Dallas, Tex.

[22] Filed: Apr. 15, 1974

[21] Appl. No.: 460,932

[52] U.S. Cl. ..... 339/221 M

[51] Int. Cl.[2] ..... H01R 9/08

[58] Field of Search ..... 339/221 R, 221 M, 217 R, 339/17 C, 220 R, 17 R, 17 CF, 17 L; 29/630 R; 174/94 R

[56] References Cited

UNITED STATES PATENTS

| | | | |
|---|---|---|---|
| 3,283,291 | 11/1966 | Krol et al. | 339/276 A |
| 3,288,915 | 11/1966 | Hatfield et al. | 29/630 R X |
| 3,371,152 | 2/1968 | Damiano | 339/221 R |
| 3,621,445 | 11/1971 | Horecky et al. | 339/17 C |
| 3,636,497 | 1/1972 | Carter | 339/221 R |
| 3,660,726 | 5/1972 | Ammon et al. | 339/17 C |
| 3,718,895 | 2/1973 | Reynolds | 339/275 B X |
| 3,730,972 | 5/1973 | Hennessey | 174/94 R |
| 3,768,068 | 10/1973 | Palecek | 339/221 M |
| 3,781,770 | 12/1973 | Mancini | 339/17 R |
| 3,783,433 | 1/1974 | Kurtz et al. | 339/217 S |
| 3,786,402 | 1/1974 | Horecky | 339/217 S X |

OTHER PUBLICATIONS

Schick, IBM Technical Bulletin, vol. 5, No. 5, Oct. 1962, p. 10.

*Primary Examiner*—Joseph H. McGlynn
*Assistant Examiner*—James W. Davie
*Attorney, Agent, or Firm*—Crisman & Moore

[57] ABSTRACT

A contact for electrical component leads is formed by first stamping an outline design from a sheet of relatively thin metal stock. The stamped piece is then bent and folded in four substantially right angle bends about the longitudinal axis of the contact. The folded contact is generally rectangular in cross-section with planar side walls including a four-sided open top lead-receiving socket portion, a four-sided press-fitting central portion and a three-sided tail portion generally square in cross-section. Each planar side of the lead-receiving socket portion also includes a tine extending angularly inwardly and downwardly to mechanically and electrically engage an axially aligned component lead when inserted down into the open top lead-receiving socket portion of the contact.

11 Claims, 8 Drawing Figures

FOLDED ELECTRICAL CONTACT

BACKGROUND OF THE INVENTION

The invention relates to contacts for an electrical connector and, more particularly, to a folded contact for receiving and connecting electrical component leads.

For certain applications, such as integrated circuit connectors, it is desirable to make electrical contact with each component lead at a plurality of different points to enable a more reliable connection with bent or misorientated leads.

Prior art approaches to solving this problem include contacts having a pair of opposed arcuate finger portions for gripping a lead therebetween. A two surface approach, while enhancing reliability somewhat, still does not circumvent the possibility of a bent lead extending away from between both surfaces. Further, arcuate contact portions do not provide as reliable a connection with a cylindrical lead as do sharp biting edges.

Prior art contacts which completely surround a component lead have generally been of the type which comprises two parts, a cylindrical screw-machined holder and a tined insert. The insert includes a plurality of resilient inwardly and downwardly extending tines arranged in a conical configuration. Such contacts possess a number of inherent disadvantages; for example, both the fact that each contact is of two parts and the fact that one is made by screw machining contribute to the expense of the part. Further, the outer portion of these prior art contacts are cylindrical with annular, snap-in retaining ribs and are devoid of longitudinally extending angular edges adapted for press-fitting into a circular aperture in a substrate.

In general it is desirable to manufacture contacts from as thin metal stock as possible in order to reduce costs. However, when a thin flat contact is press fitted it into a circular plated-through hole, it may be easily bent by transverse forces and, further gives a less reliable contact with the hole plating due to its thin knife-edge contact area. The folded contact of the present invention is made from relatively thin metal stock which, after folding, produces a contact having the same peripheral area as that of thicker stock but requiring substantially less material.

The folded contact of the present invention is especially adapted for use by press fitting into a cylindrical hole in a substrate. Prior art press fitted contacts have relied upon a rigid transversely extending shoulder and a solid press fitting neck section having longitudinally extending angular edges to slightly deform the walls of the hole and form a tight frictional fit therewith. The preferred embodiment of the folded contact of the present invention includes a shoulder-less four-sided press fitting central portion which is generally rectangular in cross-section and open down the center. The folded structure is sturdy enough for press fitting against the top of the contact and includes four longitudinally extending angular edges for engagement with the walls of the hole and a hollow cross-section that, when press fitted, resiliently deforms along with the walls of the hole to give a highly reliable frictional engagement. More particularly, the press fitted contact portion is deformed from a rectangular cross-section to a more oval or rounded shape which resiliently presses outwardly against the walls of the hole and holds the contact firmly in position.

The folded contact of the present invention overcomes many of the cost and reliability problems or prior art lead contacts while being simple to manufacture and press fit into holes in a substrate. Further, the folded contact of the present invention is readily adapted for use in the method and connector disclosed and claimed in co-pending U.S. patent application Ser. No. 406,931, filed by J. Preston Ammon Apr. 15, 1974, entitled "Low Profile Integrated Circuit Connector and Method" and assigned to the assignee of the present invention.

SUMMARY OF THE INVENTION

The invention relates to a folded contact for electrical component leads comprising an open top lead-receiving socket portion, and a press-fitting central portion having a plurality of planar sides. The lead receiving socket portion includes a plurality of inwardly and downwardly extending tines for gripping a component lead inserted therein.

In another aspect, the invention includes an electrical contact having a portion thereof adapted for press fitting into a generally circular aperature in a substrate. The press fitting portion comprises a sheet of bendable conductive material formed into a substantially closed outer peripheral surface about a longitudinally extending central opening. The outer peripheral surface includes at least one longitudinally extending planar surface to form a space between the outer planar surface of the contact and the curved inner surface of the generally circular aperture into which space material is deformed during press fitting.

In still another aspect the invention includes an interconnection system for electrical component leads comprising a substrate having a generally circular aperture formed with a conductive plating on the internal walls thereof. An elongate folded metal contact having an axially extending passageway open at both ends and peripherally surrounded by a plurality of planar wall surfaces is press fitted into the plated aperture. The contact includes a socket portion open at the top for receiving and conductively engaging the lead of an electrical component inserted therein and a central portion connected to said socket portion and including planar sidewalls having angular edges therebetween for deforming engagement with the plated material on the walls of the aperture to hold the contact rigidly in position within the aperture.

BRIEF DESCRIPTION OF THE DRAWING

For a more complete understanding of the present invention and for further objects and advantages thereof, reference may now be had to the following description taken in conjunction with the accompanying drawing, in which.

DETAILED DESCRIPTION

Figure 1:
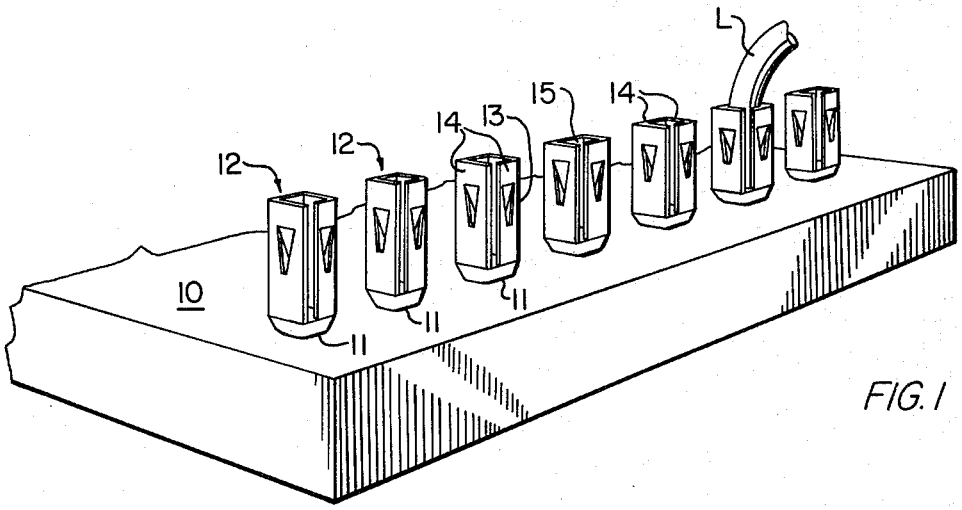
FIG. 1 is a perspective view of a plurality of the contacts of the present invention press-fitted into a linear array of holes in a substrate.

Referring to FIG. 1, there is shown a substrate 10 having a plurality of aligned holes 11 formed therein. A plurality of contacts 12, constructed in accordance with the invention, are press-fitted into the holes 11. Each contact 12 preferably includes a rectangular, lead-receiving socket portion 13 having four planar sides 14 and an open top 15 for receiving a longitudinally extending component lead into the socket portion 13. The open top 15 communicates with an axially extending passageway which is open at both ends and peripherally surrounded by the planar walls 14. Each one of the planar sides 14 of the lead receiving socket portion 13 includes an inwardly and downwardly extending tine 16 for engagement with a component lead L inserted into the top opening 15. As shown further in FIG. 3, each contact 12 also includes a press-fitting central portion 17, a tapered transition region 18 and a channel shaped tail portion 19 and may be formed with other contacts connected via a common support strip 20. The press-fitting central portion 17 is also preferably generally rectangular and formed by folding into four planar sidewalls. As will be discussed further below, the configuration of the central press-fitting portion 17 is especially adapted for resiliently gripping the inner walls of a plated-through hole into which it has been press-fitted. The tapered transition region 18 is connected to the optional tail portion 19. For certain applications, for example, where all electrical connections with the lower portion of the contact 12 are made with the plated walls of a hole, and no wire wrapping is required, it may be desirable to remove the tail portion 19 just below the transition region 18. This leaves the tapered section 18 to aid in inserting the tail-less contact into the top of a hole. For other applications where wire-wrapped terminations may be used, the tail 19 is retained on the contacts 12 and comprises a generally square three-sided channel which is readily received by an automatic wire-wrapping mechanism.

Folding, as used herein, is defined as forming a bend in a sheet of generally pliant material by angularly displacing a planar surface with respect to an adjacent surface to form a crease therebetween. In the contact of the present invention, each bend is preferably made along a straight line extending generally parallel to the longitudinal axis of the contact to form an angular edge adjacent to a planar surface.

The contacts 12 are preferably formed from sheet metal which is relatively thin (on the order of 5 mils thick) in comparison with the material conventionally used for stamping contacts (on the order of 25 mils thick). In this manner, the necessity for coining the contact to produce areas of bendable thinness are eliminated and less material is used to form a contact to fit the same size hole. For example, a contact constructed in accordance with the present invention may be folded into a 25 mil × 40 mil cross-section from 5 mil material with about 60% less material than a 25 mil × 40 mil contact stamped from material 25 mils thick.

Contacts stamped from thin material, (i.e. on the order of 5 mils thick) in the conventional manner do not produce good reliability in that when they are press-fitted into a plated hole, there is only a knife edged contact point with the walls. The folded contact of the present invention, however, is preferably rectangular in cross section which gives it added strength for increased reliability after press fitting and four angular edges for contact with the internal walls of the plated through hole. Additionally, the folded design of the contact of the present invention may include a rectangular open top lead-receiving socket portion 13 having four planar side walls for contact with a lead inserted therein.

Figure 4:
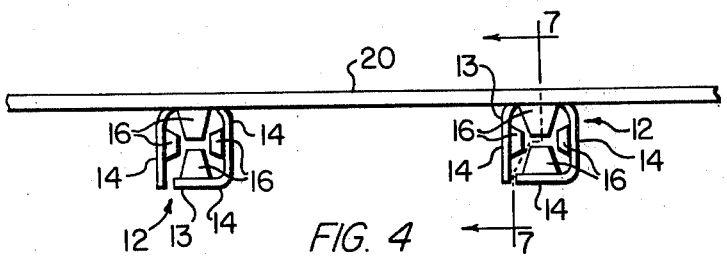
FIG. 4 is a top plan view of the contacts shown in FIG. 3.

As illustrated in the top view of FIG. 4, each of the four times 16 is formed in a planar sidewall and each projects inwardly and downwardly and is flexed resiliently outward by the insertion of a component lead. The lead-receiving socket portion 13 will receive cylindrical leads having a diameter in the range of about 8 mils to 30 mils. Even if the lead is misoriented, as long as it is inserted into the open top of the socket portion 13 it will be contacted by one or more of the tines 16. Further, the socket 13 of the contact 12 will accept and connect any shape of lead (e.g. rectangular, square, oval, etc.) even though it is not circular in cross-section.

Figure 3:
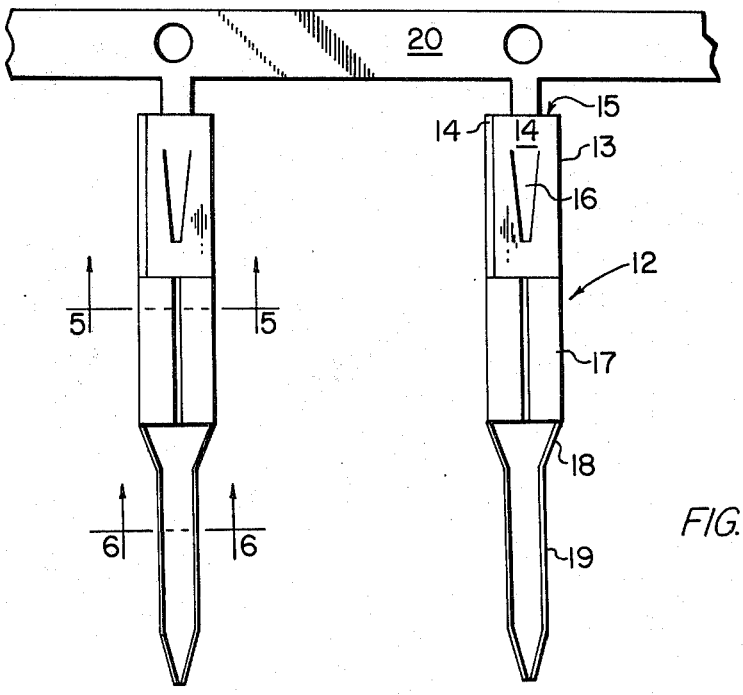
FIG. 3 is a front plan view of a plurality of the folded contacts shown in FIG. 1 attached to a common support strip.
Figure 5:
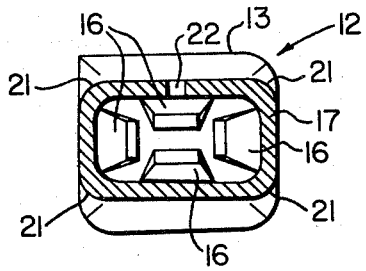
FIG. 5 is a cross-section view of one of the contacts shown in FIG. 3 taken about the lines 5—5 of FIG. 3.
Figure 6:
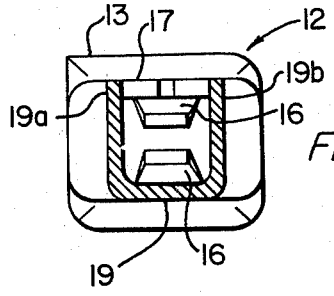
FIG. 6 is a cross-section view of one of the contacts shown in FIG. 3 taken about the lines 6—6 of FIG. 3.

FIGS. 5 and 6 show cross-sectional views taken about lines 5—5, and 6—6, respectively, of FIG. 3. In FIG. 5, there is shown a cross-section view of the four sided press-fitting central portion 17. As shown, the four folds produce four angular edge sections 21 which extend longitudinally of the contact 12 and play a significant role in interconnection with the walls of a plated thru hole. The initially planar sides of the central portion 17 are folded together except for a small gap 22. The contact 12 is especially adapted for press-fitting into a plated hole.

Figure 2:
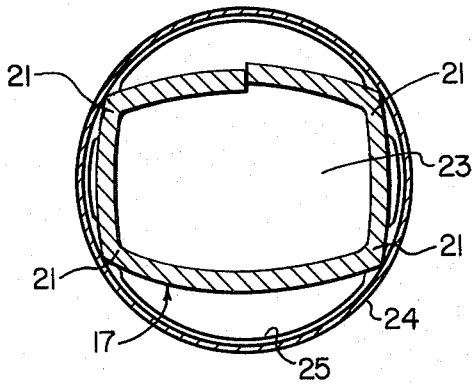
FIG. 2 is a cross-section view of a portion of one of the contacts shown in FIG. 1 press fitted into a plated through hole.

Referring to FIG. 2, there is shown a cylindrical hole 23 having been plated first with an inner layer 24 of malleable material such as copper and an outer layer 25 of malleable material such as a tin-lead composition. The inside diameter of the plated hole 23 is slightly smaller than the diagonal dimensions of the contact central portion 17 so that after press-fitting the contact 12 will be held tight and motionless within the hole. When the contact is press-fitted into the hole 23, the angular edge sections 21 deform the malleable copper and tin-lead platings 24 and 25 away from the edges 21 to form a tight frictional engagement between the contact and the conductive material on the walls of the hole 23. In the folded contact of the present invention, press fitting also deforms the central portion 17 of the contact 12 to close the gap 22 and cause the central portion 17 to assume a more rounded shape with a highly reliable electrical and mechanical connection with the conductive walls of the hole 23. The contacts of the present invention are readily adapted for use in forming a multilayer printed circuit board in accordance with U.S. Pat. No. 3,660,726 entitled, "Multi-Layer Printed Circuit Board and Method of Manufacture".

The interfacing, frictionally engaging forces between a press fitted contact and the walls of a plated hole is believed to be produced in the prior art by elastic deformation of one surface (i.e., deformation of the plating in the hole when filled by a prior art solid shank) and to be produced in the present invention by elastic deformation of two surfaces (i.e., deformation of both hole plating and the central portion of the contact of the invention). After press fitting, the outside surfaces of the central portion of the present contact are slightly bowed and press outwardly against the walls of the hole so that it is less likely that both the material of the walls of the hole and of the contact will be deformed passed their elasticity. From FIG. 2 is can be seen that the sidewalls of the central portion of the contact remain generally planar, having been bowed slightly outwardly by press fitting, while the hole remains generally circular to leave some spaces between the two interfacing elements and permit elastic deformation of both elements with continued opposing resilience by each. With the contact of the present invention, press-fitting deforms both the conductive material on the inner walls of the hole and the resilient sides of the central portion of the contact to provide a high degree of reliability in the mechanical and electrical interconnection.

In FIG. 6, there is shown a cross-section view of the three sided tail portion 19 which is generally square to facilitate processing by automatic wire-wrapping equipment when desired. The channel shaped tail portion is generally acceptable for wire wrapped terminations and allows the formation of a 25 mil × 25 mil square tail from 5 mil thick material.

Figure 7:
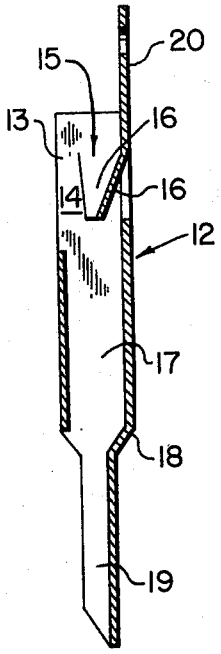
FIG. 7 is a partially cut-away longitudinal cross-section view of one of the contacts, taken about lines 7—7 of FIG. 4, showing inwardly and downwardly extending tines.

As shown in FIG. 7, the lead-receiving socket portion 13 of the contact 12 includes a plurality of planar walls 14 having inwardly and downwardly extending tines 16. The tines 16 are formed by stamping before the contact is folded and include sharp biting edges. When a component lead L (FIG. 1) is inserted longitudinally down into the top opening 15, the tines 16 are deflected resiliently outward to exert an inwardly biased force and thereby form a highly reliable, four point interconnection with the lead.

Certain prior art press-fitted contacts include a shoulder portion between the contactor portion and the press-fitting neck section to provide means for applying force to the contact to press it down into an aperture. Other prior art contacts are press fitted by pulling them through an aperture by the tail from the opposite side to avoid either inclusion of a press fit shoulder or applying force directly to the top portion of the contact. The contact of the present invention, by virtue of its poly-sided, folded configuration, may be press-fitted by applying force directly to the top of the lead receiving socket portion 13. This feature allows the press-fitting shoulder portion to be eliminated thereby producing contacts which are shorter in overall height and which may be placed adjacent one another on considerably smaller centers without danger of accidental shorting of one to another.

It should be noted that in press fitting the present contact into an aperture a "stop" is preferably used to indicate when the contact has been fully inserted and prevent crushing. The insulator disclosed in the aforementioned copending patent application entitled "Low Profile Integrated Circuit Connector and Method" incorporates a built in "stop".

Other alternate embodiments of the present folded contact may include a cylindrical socket portion and a planar sided, press-fitting central portion which is hollow and generally triangular in cross section with three outside angular edge sections for press fitting into a generally circular aperture.

Figure 8:
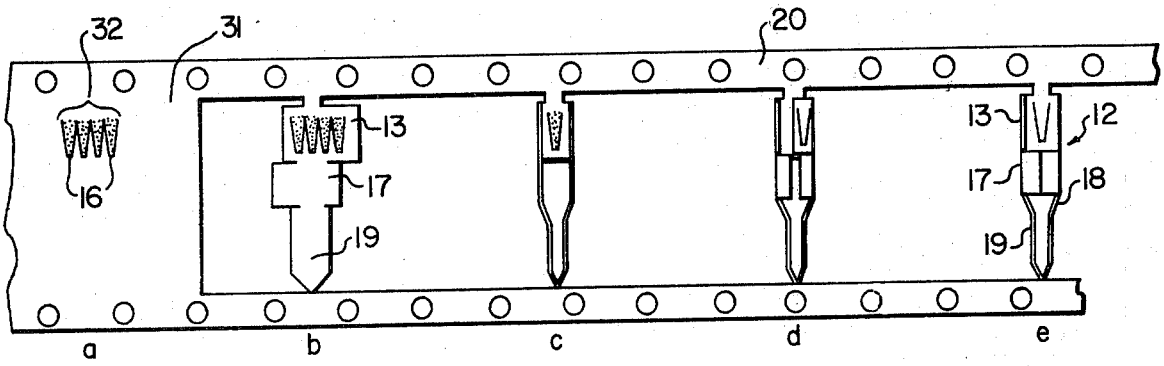
FIG. 8 is a top plan view of a strip of contact material in various stages of the sequential operations of plating, stamping and folding into finished contacts.

As illustrated in FIG. 8, the preferred embodiment of the contact of the present invention is made by sequentially stamping and folding the stamped outline into a finished contact. A strip of relatively thin metal stock 31, such as heat treated beryllium copper, if first either completely or selectively plated with a low resistance contactor material such as gold. In the preferred embodiment, a small region 32, which will actually make connection with component leads, is selectively plated and them stamped, at location "*a*", to form four upwardly extending tines 16. At location "*b*", the outline of the unfolded contact is stamped and separated from the surrounding metal sheet. The regions 13, 17, and 19 which will be folded, respectively, into the lead-receiving socket portion, the press-fitting central portion and the tail portion can be distinguished at this point. At location "*c*", the outer sides are folded up and at location "*d*", the final folds are made to produce a virtually finished contact, as shown in location "*e*". As is apparent, a common carrier strip 20 may be left joining either the tops or the tails of the contacts for ease in handling and further assembly.

The contacts of the present invention may be assembled into a substrate in accordance with U.S. Pat. No. 3,676,926 entitled, "Method for Manufacturing Connector Terminals."

In summary, it can be seen how the folded contact of the present invention provides a sturdy contact which is smaller in both length and width than prior art solid contacts and formed from relatively thin material. The contact of the present invention further provides a more reliable connection with both a plated hole into which it is press fitted and a component lead which is inserted into the contact.

The structural and procedural aspects of the invention have been described above with reference to certain preferred embodiments of the invention, which have been selected from the many embodiments which the invention might take, for purposes of example and illustration. Persons skilled in the art and technology to which this invention pertains will recognize that the specific structures and procedures described may be modified or altered somewhat while still utilizing the advances and improvements provided by the invention. Accordingly the foregoing description should be regarded as explanatory and illustrative, rather than limiting of the scope of the invention.

What is claimed is:

1. An interconnection system for electrical component leads, comprising:

a substrate having a generally circular aperture formed therein;

a conductive plating formed on the internal walls of said aperture;

an elongate metal contact formed from a sheet of conductive material folded into a polysided, planar walled body having an enclosed axially extending passageway generally open at both ends and including, a polysided socket portion of substantially closed perimeter open at the top for receiving, mechanically securing, and conductively engaging a lead of an electrical component inserted therein; and a polysided central portion of substantially closed perimeter integral with and axially extending from said socket portion forming axially extending angular edges of substantially greater curvature than said aperture and being press fitted into said aperture for deforming engagement with the plated material on the walls thereof to hold said contact rigidly in position in said aperture and effect a reliable electrical and mechanical contact therebetween.

2. An interconnection system for electrical component leads, as set forth in claim 1 wherein:

each of the planar walls of said socket portion includes aa resilient tine extending inwardly and downwardly into the socket to electrically and mechanically engage a component lead inserted therein.

3. As interconnection system for electrical component leads, as set forth in claim 1 wherein:

said polysided structure comprises four folded planar walls positioned at substantially right angles to one anothere to form a contact of generally closed, rectangular cross section.

4. An interconnection system for electrical component leads as set forth in claim 1 wherein said contact also includes:

a channel shape tail portion connected to, and narrower than, said central portion extending axially therefrom in rigid vertical alignment therewith, said tail having three planar side walls open on one side to resiliently receive wire interconnections wrapped circumferentially about said tail; and a transition region connected between said central portion and said narrower tail portion defining said rigid vertical alignment therebetween.

5. An improved interconnection system of the type having a contact of one piece construction stamped from conductive material, formed into an elongated body and mounted by press-fit insertion within a generally circular aperture in a substrate and which contact is adapted for rigidly withstanding the insertion force and effecting a reliable electrical and mechanical connection between electrical conductors, wherein said improvement comprises:

a planar substrate having an aperture formed therethrough with a conductive coating covering the walls thereof;

a contact body having an enclosed axially extending passageway therethrough with axially extending planar sides in a folded, polysided construction of cross-sectional size relatively larger than the diameter of said plated through aperture including, a lower aperture engaging portion having a plurality of angular edges formed between said planar sides of a curvature substantially greater than that of said aperture in deforming, interfering engagement with the plated material on the walls thereof to hold said contact rigidly therein and effect a reliable electrical and mechanical contact therebetween and the solidity of a permanent mounting; and an upper component lead receiving portion extending uprightly from said lower aperture engaging portion along said planar sides thereof, and having an uppermost edge lying in a common plane generally perpendicular to said axially extending planar walls for uniformly receiving, transferring and ridigly withstanding the press fit insertion force thereacross.

6. A contact as set forth in claim 5 wherein:

each planar wall of said upper end includes a resilient tine extending inwardly and downwardly therein to electrically and mechanically engage a component lead inserted therein.

7. A contact as set forth in claim 5 wherein: said contact body is formed from a sheet of bendable, conductive material folded about a plurality of parallel, longitudinally extending lines to form said planar sides.

8. A contact as set forth in claim 5 wherein: said sheet is folded about at least three longitudinal lines to form a four sided, substantially closed perimeter contact, generally square in cross-section.

9. In an interconnection system for electrical component leads, the combination comprising:

a planar substrate having a plurality of generally circular apertures therein, said apertures forming arrays lying along linear paths and including a conductive plating formed on the internal walls of said apertures;

an elongate contact formed from a sheet of conductive material folded into a polysided, planar walled body having an enclosed axially extending passageway generally open at both ends and including;

a polysided central portion of substantially closed perimeter having axially entending, angular edge sections of substantially greater curvature than said aperture and being press fitted into said aperture for deforming engagement with the plated material on the walls thereof to hold said contact rigidly in position in said aperture and effect a reliable electrical and mechanical connection therebetween;

a polysided socket portion of substantially closed perimeter formed integral with and extending axially above said central portion, said socket portion being open at the top for receiving, mechanically securing, and conductively engaging a lead of an electrical component inserted therein, said open top being formed by the uppermost edges of the planar walls, said edges lying in a generally common plane and said plane being substantially perpendicular to each of said walls for uniformly receiving and rigidly withstanding a press fitting insertion force applied to said uppermost socket edges;

a channel shaped tail portion formed integral and axially aligned with, but narrower than, said central portion, said tail portion having three generally rectangular planar side walls open on one side to resiliently receive interconnections wrapped circumferentially about said tail; and a transition region connecting said central portion and said narrower tail portion to provide rigid vertical alignment therebetween.

10. An interconnection system for electrical component leads, as set forth in claim 9 wherein:

each of the planar walls of said socket portion includes aa resilient tine extending inwardly and downwardly into the socket to electrically and mechanically engage a component lead inserted therein.

11. An interconnection system for electrical component leads, as set forth in claim 9 wherein:

said polysided structure comprises four folded planar walls positioned at substantially right angles to one another to form a contact of generally closed, rectangular cross-section.

* * * * *